US007187133B2

(12) United States Patent
Oh

(10) Patent No.: US 7,187,133 B2
(45) Date of Patent: Mar. 6, 2007

(54) ORGANIC ELECTROLUMINESCENT DISPLAY DEVICE AND DRIVING METHOD THEREOF

(75) Inventor: Du-Hwan Oh, Chungcheongbukdo (KR)

(73) Assignee: L.G.Phillips LCD Co., Ltd., Seoul (KR)

( * ) Notice: Subject to any disclaimer, the term of this patent is extended or adjusted under 35 U.S.C. 154(b) by 113 days.

(21) Appl. No.: 11/111,801

(22) Filed: Apr. 22, 2005

(65) Prior Publication Data

US 2006/0238475 A1 Oct. 26, 2006

(30) Foreign Application Priority Data

Dec. 29, 2003 (KR) ..... 10-2003-0098821

(51) Int. Cl.
*G09G 3/10* (2006.01)
*G09G 5/10* (2006.01)

(52) U.S. Cl. ..... 315/169.3; 345/76; 345/204

(58) Field of Classification Search ..... 315/169.1, 315/169.3; 345/44–46, 48, 52, 55, 76, 90, 345/92, 204, 211
See application file for complete search history.

(56) References Cited

U.S. PATENT DOCUMENTS 6,774,572 B2 * 8/2004 Fukuzako ..... 315/169.1
6,952,083 B2 * 10/2005 Fukuzako ..... 315/169.1
6,989,826 B2 * 1/2006 Kasai ..... 345/204
7,106,006 B2 * 9/2006 Koyama ..... 315/169.3
2005/0116902 A1 * 6/2005 Miyzawa ..... 345/76

FOREIGN PATENT DOCUMENTS

KR 1020020018264 A 3/2002

* cited by examiner

*Primary Examiner*—Trinh Vo Dinh
(74) *Attorney, Agent, or Firm*—McKenna Long & Aldridge, LLP

(57) ABSTRACT

An organic electroluminescent display device includes a gate line receiving a gate signal, a data line crossing the gate line, the data line receiving a data signal, a first transistor switching the data signal according to the gate signal, the first transistor being turned on during a single horizontal scan time period having first and second sub-periods, a second transistor switching a source voltage according to the data signal and connected to the first transistor, a storage capacitor connected to a first node between the first and second transistors and connected to the source voltage, a third transistor switching a first voltage signal and connected to the second transistor, the first voltage signal having different voltage levels during the first and second sub-periods of the scan time period, and an organic electroluminescent diode connected to a second node between the second and third transistors and connected to a ground voltage.

20 Claims, 6 Drawing Sheets

ORGANIC ELECTROLUMINESCENT DISPLAY DEVICE AND DRIVING METHOD THEREOF

BACKGROUND OF THE INVENTION

1. Field of the Invention

The present invention relates to an organic electroluminescent display device, and more particularly, to an organic electroluminescent display device having a lengthened life time and a stability in operation and a driving method thereof.

2. Discussion of the Related Art

Among flat panel displays (FPDs), organic electroluminescent (EL) devices have been of particular interest in research and development because they are self-light-emitting type displays having a wide viewing angle as well as a high contrast ratio in comparison to liquid crystal display (LCD) devices. Organic EL devices are lightweight and small, as compared to other types of display devices, because they do not need a backlight. Organic EL devices have other desirable characteristics, such as low power consumption, superior brightness and fast response time. When driving the organic EL devices, only a low direct current (DC) voltage is required. Moreover, a fast response time can be obtained.

Unlike LCD devices, organic EL devices are entirely formed in a solid phase arrangement. Thus, organic EL devices are sufficiently strong to withstand external impacts and also have a greater operational temperature range. Moreover, organic EL devices are fabricated in a relatively simple process involving few processing steps. Thus, it is much cheaper to produce an organic EL device in comparison to an LCD device or a plasma display panel (PDP). For example, only deposition and encapsulation processes are necessary for manufacturing organic EL devices. An organic EL device is often referred to as an organic light emitting diode (OLED).

There are two types of organic EL display devices: passive matrix type and active matrix type. While both the passive matrix organic EL display device and the active matrix organic EL display device have simple structures and are formed by a simple fabricating process, the passive matrix organic EL display device requires a relatively high amount of power to operate. In addition, the display size of a passive matrix organic EL display device is limited by its structure. Furthermore, as the number of conductive lines increases, the aperture ratio of a passive matrix organic EL display device decreases.

In contrast, active matrix organic EL display devices are highly efficient and can produce a high-quality image for a large display size with a relatively low power. In general, in an active matrix type organic EL device, a voltage controlling a current applied to a pixel is stored in a storage capacitor. Accordingly, the voltage in the storage capacitor can be applied to the pixel until a next frame and the pixel can continuously display an image during one frame. As a result, an active matrix type organic EL device has a low power consumption, a high resolution and a large display size because it can display images with a constant brightness even with a low driving current.

FIG. 1 is a circuit diagram showing an organic electroluminescent display device according to the related art. In FIG. 1, an organic electroluminescent display (ELD) device includes a plurality of gate lines "S1" to "Sm" and a plurality of data lines "D1" to "Dn." Each gate line crosses each data line, thereby defining a pixel region. Each pixel region includes a first positive (P) type transistor "P1," a storage capacitor "C1," a second P type transistor "P2" and an organic electroluminescent (EL) diode "OEL." The first and second P type transistors function as switching and driving elements for the organic ELD device "OEL," respectively.

In particular, a gate electrode and a source electrode of the first P type transistor "P1" are respectively connected to a corresponding one of the gate lines "S1" to "Sm" and to a corresponding one of the data lines "D1" to "Dn." The storage capacitor "C1" is connected to a drain electrode of the first P type transistor "P1" and a source voltage "Vdd." A gate electrode of the second P type transistor "P2" is connected to the drain electrode of the first P type transistor "P1." In addition, a source electrode and a drain electrode of the second P type transistor "P2" are connected to the source voltage "Vdd" and the organic EL diode "OEL," respectively.

When a gate signal of a low level voltage is applied to the gate line, the first P type transistor "P1" is turned on and the storage capacitor "C1" is charged up by the source voltage "Vdd" according to a data signal applied to the second P type transistor "P2" through the first P type transistor "P1." A quantity of a current passing through the second P type transistor "P2" is determined by a voltage stored in the storage capacitor "C1" and the organic EL diode "OEL" emits light according to the current quantity. Further, the gate lines "S1" to "Sm" are sequentially enabled, and the data signals are applied to the pixel regions corresponding to the enabled gate line through the data lines "D1" to "Dn."

However, the current flows through the organic EL diode "OEL" only along one direction. As a result, the organic EL diode "OEL" is deteriorated due to a direct current (DC) current and a lifetime of the organic EL diode "OEL" is shortened.

FIG. 2 is a circuit diagram showing another organic electroluminescent display device according to the related art. In FIG. 2, an organic electroluminescent display (ELD) device includes a plurality of gate lines "S1" to "Sm" and a plurality of data lines "D1" to "Dn." Each gate line crosses each data line, thereby defining a pixel region. Each pixel region includes a first negative (N) type transistor "N1," a storage capacitor "C2," a second N type transistor "N2," a third transistor "P3," which is a P-type transistor, and an organic electroluminescent (EL) diode "OEL." The first transistor "N1" functions as a switching element for the organic ELD device, and the second and third transistors "N2" and "P3" function as driving elements for the organic ELD device.

A gate electrode and a drain electrode of the first transistor "N1" are respectively connected to a corresponding one of the gate lines "S1" to "Sm" and to a corresponding one of the data lines "D1" to "Dn." The storage capacitor "C2" is connected to a source electrode of the first transistor "N1" and a first voltage "V1." A gate electrode of the third transistor "P3" is connected to the source electrode of the first transistor "N1." In addition, a source electrode and a drain electrode of the third transistor "P3" are connected to a source voltage "Vdd" and the organic EL diode "OEL," respectively. A gate electrode of the second transistor "N2" is connected to the source electrode of the first transistor "N1." Further, a source electrode and a drain electrode of the second transistor "N2" are connected to the first voltage "V1" and the organic EL diode "OEL," respectively. The organic EL diode "OEL" is connected to a ground voltage "Vcom." The ground voltage "Vcom" is lower than the source voltage "Vdd."

FIG. 3 is a schematic timing chart showing a method of driving the organic electroluminescent display device shown in FIG. 2. As shown in FIG. 3, a plurality of gate signals "$V_{S1}$" to "$V_{Sm}$" sequentially have a high level voltage pulse during one horizontal scan time period "1H." Thus, the gate lines "S1" to "Sm" (of FIG. 2) are sequentially enabled by the gate signals "$V_{S1}$" to "$V_{Sm}$." In particular, when the high level voltage pulse is applied to a corresponding one of the gate lines "S1 " to "Sm" (of FIG. 2), the first transistors "N1" (of FIG. 2) connected to the corresponding gate line are turned on and first data signals are applied to the plurality of data lines "D1" to "Dn" (of FIG. 2). Next, the first transistors "N1" (of FIG. 2) connected to the next gate line are turned on and second data signals are applied to the plurality of data lines "D1" to "Dn" (of FIG. 2). Although not shown, the first voltage "V1" is fixed and remains the same during the operation.

For example, when the first gate line "S1" (of FIG. 2) is enabled during one horizontal scan time period "1H," the first transistors "N1" (of FIG. 2) connected to the first gate line "S1" (of FIG. 2) are turned on and the first data signal "$V_{D11}$" for the first data line "D1" (of FIG. 2) is input to the first transistor "N1" (of FIG. 2) connected to the first data line "D1" (of FIG. 2). The first data signal "$V_{D11}$" for the first data line "D1" (of FIG. 2) has a high level voltage during a first sub-period of the one horizontal scan time period "1H" and a low level voltage during a second sub-period of the one horizontal scan time period "1H."

In addition, a difference between the high level voltage of the first data signal "$V_{D11}$" and the first voltage "V1" (of FIG. 2) is higher than a threshold voltage of the second transistor "N2" (of FIG. 2), and a difference between the high level voltage of the first data signal "$V_{D11}$" and the source voltage "Vdd" (of FIG. 2) is lower than a threshold voltage of the third transistor "P3" (of FIG. 2). Thus, during the first sub-period of the one horizontal scan time period "1H," the high level voltage of the first data signal "$V_{D11}$" for the first data line "D1" (of FIG. 2) is applied to the second and third transistors "N2" and "P3" (of FIG. 2) through the first transistor "N1" (of FIG. 2), such that the second transistor "N2" (of FIG. 2) is turned on and the third transistor "P3" is turned off. Further, since the first voltage "V1" (of FIG. 2) is lower than the ground voltage "Vcom" (of FIG. 2), a reverse bias is applied to the organic EL diode "OEL" (of FIG. 2). As a result, the organic EL diode "OEL" (of FIG. 2) is reset by the reverse bias during the first sub-period of the one horizontal scan time period "1H," and this process may be referred to as an aging for preventing a deterioration of an organic EL diode due to a direct current (DC) bias.

Moreover, a difference between the low level voltage of the first data signal "$V_{D11}$" and the first voltage "V1" (of FIG. 2) is lower than a threshold voltage of the second transistor "N2" (of FIG. 2), and a difference between the low level voltage of the first data signal "$V_{D11}$" and the source voltage "Vdd" (of FIG. 2) is higher than a threshold voltage of the third transistor "P3" (of FIG. 2). Thus, during the second sub-period of the one horizontal scan time period "1H," the low level voltage of the first data signal "$V_{D11}$" for the first data line "D1" (of FIG. 2) is applied to the second and third transistors "N2" and "P3" (of FIG. 2) through the first transistor "N1" (of FIG. 2), such that the second transistor "N2" (of FIG. 2) is turned off and the third transistor "P3" is turned on. Further, since the source voltage "Vdd" (of FIG. 2) is higher than the ground voltage "Vcom" (of FIG. 2), the organic EL diode "OEL" (of FIG. 2) emits light by a forward bias between the source voltage "Vdd" (of FIG. 2) and the ground voltage "Vcom" (of FIG. 2).

Therefore, the organic EL diode "OEL" (of FIG. 2) is reset by the reverse bias during the first sub-period of the one horizontal scan time period "1H," and emits light by the forward bias during the second sub-period of the one horizontal scan time period "1H." However, during the operation of the organic EL diode "OEL" (of FIG. 2), the storage capacitor "C2" (of FIG. 2) connected to the first voltage "V1" (of FIG. 2) functions as a load while the first voltage "V1" (of FIG. 2) is applied to the organic EL diode "OEL" (of FIG. 2). Accordingly, an operation speed is reduced and a power consumption increases, thereby reducing an aging efficiency.

SUMMARY OF THE INVENTION

Accordingly, the present invention is directed to an organic electroluminescent display device and a driving method thereof that substantially obviate one or more of the problems due to limitations and disadvantages of the related art.

An object of the present invention is to provide an organic electroluminescent display device where a reverse bias is applied to an organic electroluminescent diode without reduction of operation speed and increase of power consumption, and a driving method thereof.

Another object of the present invention is to provide an organic electroluminescent display device where an aging efficiency is improved by reducing a load, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the organic electroluminescent display device includes a gate line receiving a gate signal, a data line crossing the gate line, the data line receiving a data signal, a first transistor switching the data signal according to the gate signal, the first transistor being turned on during a single horizontal scan time period having first and second sub-periods, a second transistor switching a source voltage according to the data signal and connected to the first transistor, a storage capacitor connected to a first node between the first and second transistors and connected to the source voltage, a third transistor switching a first voltage signal and connected to the second transistor, the first voltage signal having different voltage levels during the first and second sub-periods of the single horizontal scan time period, and an organic electroluminescent diode connected to a second node between the second and third transistors and connected to a ground voltage.

In another aspect, the method of driving an organic electroluminescent display device includes turning on a first transistor during a single horizontal scan time period having first and second sub-periods, inputting a data signal to a second transistor through the first transistor during the single horizontal scan time period, storing charges corresponding to the data signal in a storage capacitor, the storage capacitor being between two electrodes of the second transistor, applying a first voltage signal to an organic electroluminescent diode through a third transistor during the first sub-period of the single horizontal scan time period, and applying a source voltage to the organic electroluminescent diode through the second transistor during the second sub-period of the single horizontal scan time period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
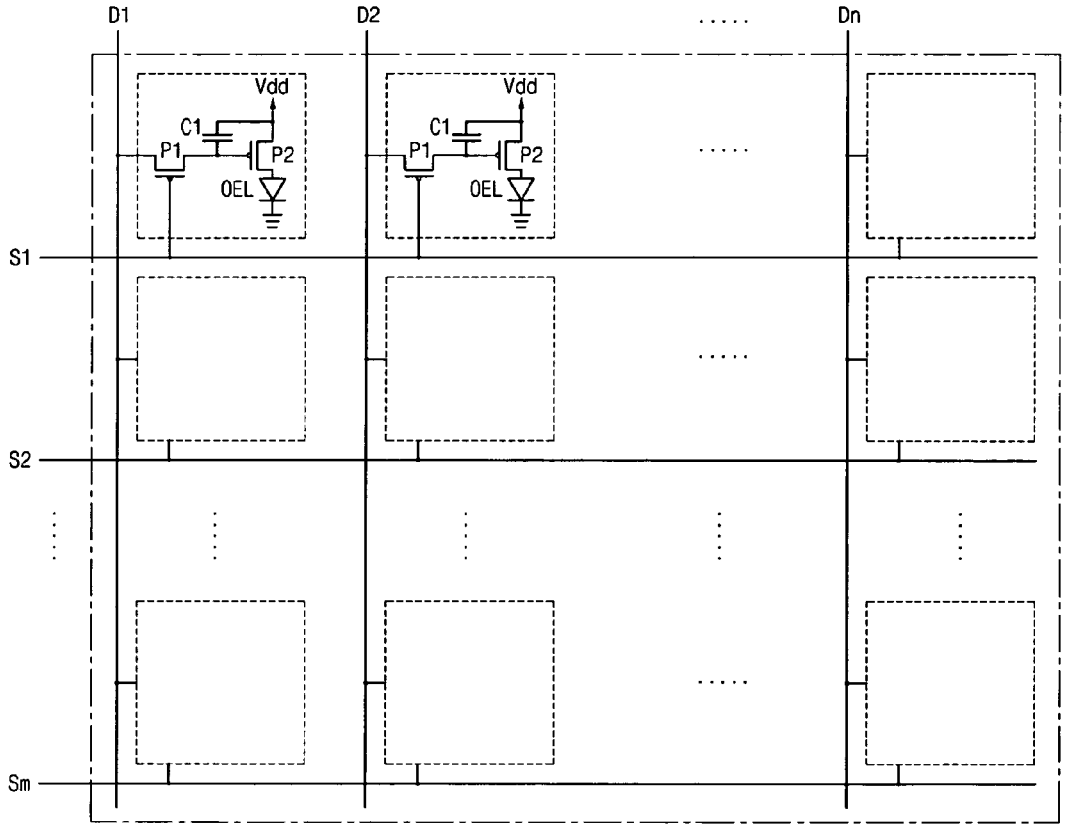
FIG. 1 Related Art
FIG. 1 is a circuit diagram showing an organic electroluminescent display device according to the related art.
Figure 2:
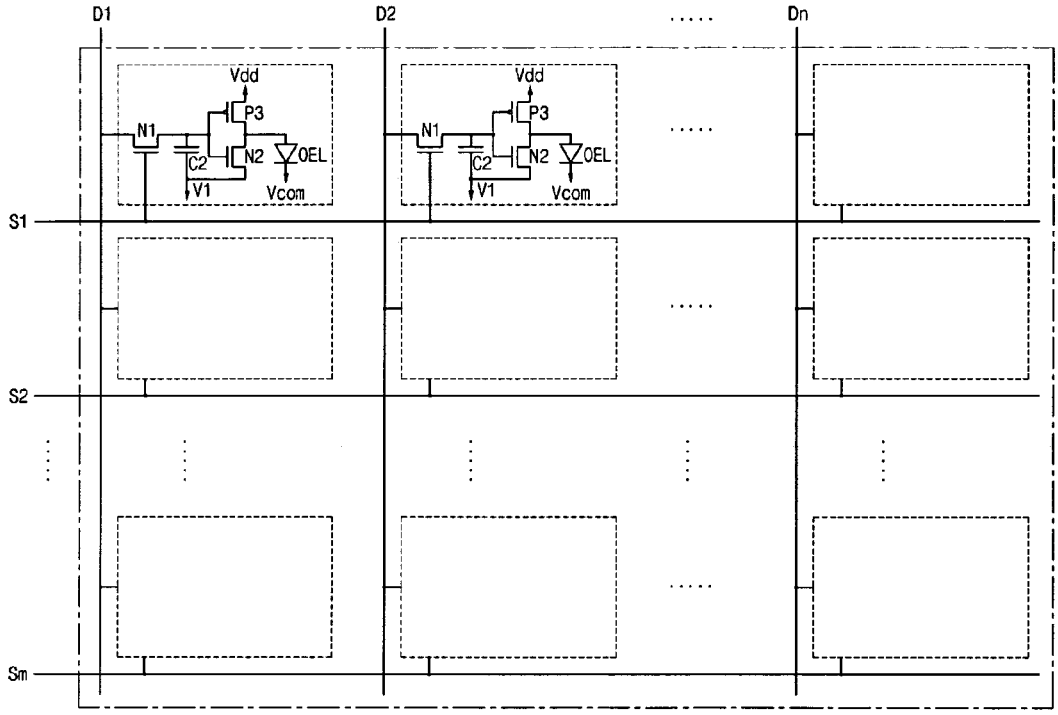
FIG. 2 Related Art
FIG. 2 is a circuit diagram showing another organic electroluminescent display device according to the related art.
Figure 3:
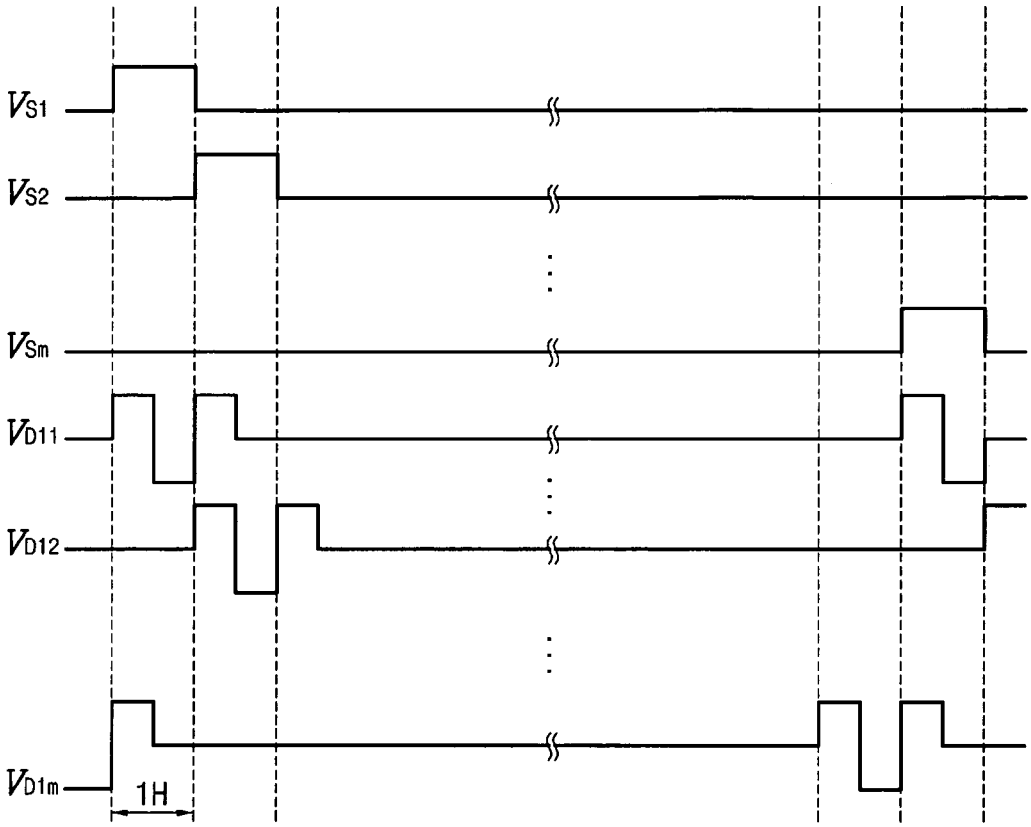
FIG. 3 Related Art
FIG. 3 is a schematic timing chart showing a method of driving the organic electroluminescent display device shown in FIG. 2.
Figure 4:
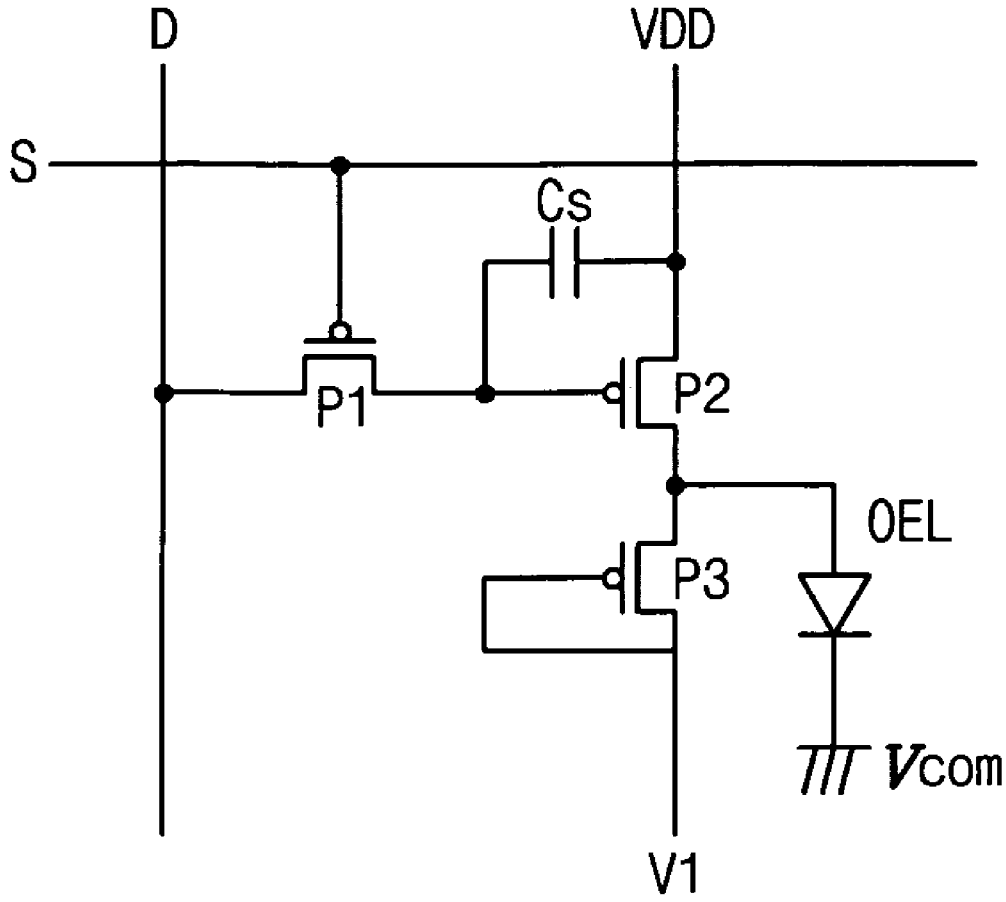
FIG. 4 is a circuit diagram showing an organic electroluminescent display device according to an embodiment of the present invention.

FIG. 4 is a circuit diagram showing an organic electroluminescent display device according to an embodiment of the present invention. In FIG. 4, an organic EL display device includes a gate line "S" crossing a data line "D," thereby defining a pixel region. Even though only a single gate line and a single data line are shown, the organic EL display device may include a plurality of gate lines and a plurality of data lines, thereby defining a plurality of pixel regions. Each pixel region includes first, second and third transistors "P1," "P2" and "P3", a storage capacitor "$C_S$" and an organic electroluminescent (EL) diode "OEL." The first, second and third transistors "P1," "P2" and "P3" may be positive (P) type thin film transistors.

In particular, the first transistor "P1" connected to the gate line "S" and the data line "D" is turned on/off according to a gate signal applied to the gate line "S." The second transistor "P2" is connected to a source voltage "VDD" and controls a current input to the organic EL diode "OEL" according to the data signal from the data line "D" through the first transistor "P1." The third transistor "P3" is connected to a first voltage "V1" and applies a reverse bias to the organic EL diode "OEL" according to the first voltage "V1." The first transistor "P1" may function as a switching element, the second transistor "P2" may function functioning as a driving element, and the third transistor "P3" may function as another driving element.

A storage capacitor "Cs" storing charges corresponding to the data signal is connected to a node between the first and second transistors "P1" and "P2" and the source voltage "VDD." The organic EL diode "OEL" emitting light according to a current amount is connected to a node between the second and third transistors "P2" and "P3" and a ground voltage "Vcom." For example, the organic EL diode "OEL" may include first and second electrodes and a luminescent layer formed between the first and second electrodes. In addition, the first electrode of the organic EL diode "OEL" may be an anode connected to the second and third transistors "P2" and "P3," and the second electrode of the organic EL diode "OEL" may be a cathode connected to the ground voltage "Vcom" to be grounded.

Figure 5:
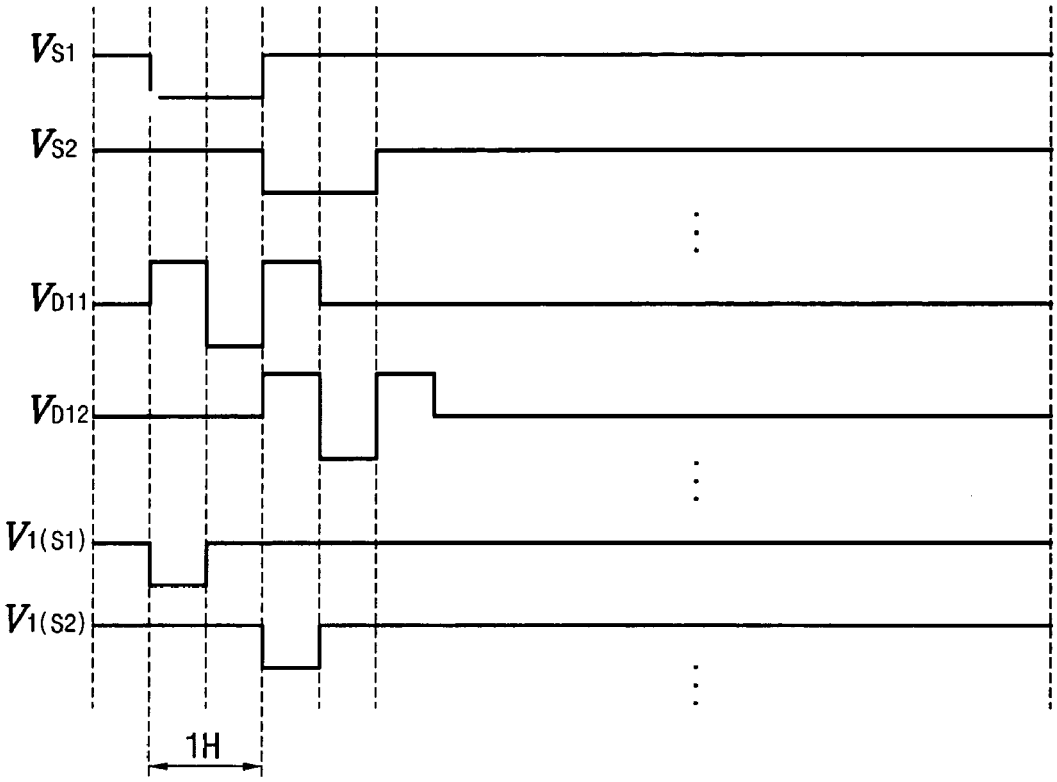
FIG. 5 is a schematic timing chart showing a method of driving the organic electroluminescent display device shown in FIG. 4 according to an embodiment of the present invention.

FIG. 5 is a schematic timing chart showing a method of driving the organic electroluminescent display device shown in FIG. 4 according to an embodiment of the present invention. As shown FIG. 5, a plurality of gate signals, e.g., "$V_{S1}$," and "$V_{S2}$," sequentially have a low level voltage pulse during one horizontal scan time period "1H." Thus, corresponding gate lines are sequentially enabled by the gate signals "$V_{S1}$," and "$V_{S2}$." In particular, when the low level voltage pulse is applied to a corresponding one of the gate lines, the first transistors "P1" (of FIG. 4) connected to the corresponding gate line are turned on and first data signals are applied to the data lines "D" (of FIG. 4). Next, the first transistors "P1" (of FIG. 4) connected to the next gate line are turned on and second data signals are applied to the data lines "D" (of FIG. 4).

For example, when a first gate line (not shown) is enabled during one horizontal scan time period "1H," the first transistors "P1" (of FIG. 4) connected to the first gate line are turned on and the first data signal "$V_{D11}$" for the first data line (not shown) is input to the first transistor "P1" (of FIG. 4) connected to the first data line. The first data signal "$V_{D11}$" for the first data line is set to have a high level voltage during a first sub-period of the one horizontal scan time period "1H" and a low level voltage during a second sub-period of the one horizontal scan time period "1H." In addition, the first voltage "V1" (of FIG. 4) is set to have a low level voltage during the first sub-period of the one horizontal scan time period "1H" and a high level voltage during the second sub-period of the one horizontal scan time period "1H."

During the first sub-period of the one horizontal scan time period "1H," since the high level voltage of the first data signal "$V_{D11}$" for the first data line (not shown) is applied to a gate electrode of the second transistor "P2" (of FIG. 4) of a P type through the first transistor "P1" (of FIG. 4), the second transistor "P2" (of FIG. 4) is turned off. Since the low level voltage of the first voltage "V1" is applied to a gate electrode of the third transistor "P3" of a P type during the first sub-period of the one horizontal scan time period "1H," the third transistor "P3" is turned on.

Further, the low level voltage of the first voltage "V1" is set to be lower than the ground voltage "Vcom" (of FIG. 4). Thus, the low level voltage of the first voltage "V1" is applied to the organic EL diode "OEL" (of FIG. 4) through the third transistor "P3" (of FIG. 4), thereby applying a reverse bias to the organic EL diode "OEL" (of FIG. 4). As a result, the organic EL diode "OEL" (of FIG. 4) is reset by the reverse bias during the first sub-period of the one horizontal scan time period "1H" and a stress due to a DC current is released.

During the second sub-period of the one horizontal scan time period "1H," since the low level voltage of the first data signal "$V_{D11}$" for the first data line "D1" (not shown) is applied to the second transistor "P2" (of FIG. 4) through the first transistor "P1" (of FIG. 4), the second transistor "P2" (of FIG. 4) is turned on. Further, a difference between the low level voltage of the first data signal "$V_{D11}$" and the source voltage "VDD" (of FIG. 4) is set to be higher than a threshold voltage of the second transistor "P2" (of FIG. 4), and the source voltage "VDD" (of FIG. 4) is set to be higher than the ground voltage "Vcom" (of FIG. 4). Thus, the source voltage "VDD" is applied to the organic EL diode "OEL" (of FIG. 4), and the organic EL diode "OEL" (of FIG. 4) emits light by a forward bias between the source voltage "VDD" (of FIG. 4) and the ground voltage "Vcom" (of FIG. 4). In addition, since the first voltage "V1" has the high level voltage during the second sub-period of the one horizontal scan time period "1H," the third transistor "P3" is turned off.

Therefore, the organic EL diode "OEL" (of FIG. 4) is reset by the reverse bias during the first sub-period of the one horizontal scan time period "1H," and emits light by the forward bias during the second sub-period of the one horizontal scan time period "1H." As a result, a stress due to a DC current is released and a lifetime of the organic EL diode "OEL" is lengthened. In addition, since the storage capacitor "Cs" (of FIG. 4) is not directly connected to the first voltage "V1," a load connected to the first voltage "V1" having an AC voltage is reduced and a power consumption of the organic ELD device is improved. Moreover, a charging time for the reverse bias is reduced and a reset efficiency is improved.

Figure 6:
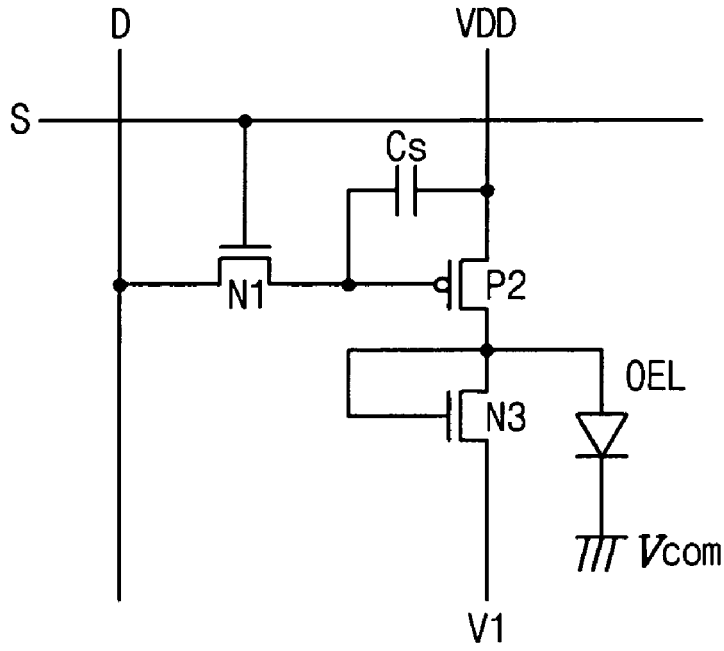
FIG. 6 is a circuit diagram showing an organic electroluminescent display device according to another embodiment of the present invention.

FIG. 6 is a circuit diagram showing an organic electroluminescent display device according to another embodiment of the present invention. In FIG. 6, an organic EL display device includes a gate line "S" crossing a data line "D," thereby defining a pixel region. Even though only a single gate line and a single data line are shown, the organic EL display device may include a plurality of gate lines and a plurality of data lines, thereby defining a plurality of pixel regions. Each pixel region includes first, second and third transistors "N1," "P2" and "N3", a storage capacitor "$C_S$" and an organic electroluminescent (EL) diode "OEL." The first and third transistors, "N1" and "N3," may be negative (N) type thin film transistors, and the second transistor "P2" may be a positive (P) type thin film transistor.

In particular, the first transistor "N1" connected to the gate line "S" and the data line "D" is turned on/off according to a gate signal applied to the gate line "S." The second transistor "P2" is connected to a source voltage "VDD" and controls a current input to the organic EL diode "OEL" according to the data signal from the data line "D" through the first transistor "N1." The third transistor "N3" is connected to a first voltage "V1" and applies a reverse bias to the organic EL diode "OEL" according to a voltage at a node between the second and third transistors "P2" and "N3." The first transistor "N1" may function as a switching element, the second transistor "P2" may function functioning as a driving element, and the third transistor "N3" may function as another driving element.

A storage capacitor "Cs" storing charges corresponding to the data signal is connected to a node between the first and second transistors "N1" and "P2" and the source voltage "VDD." The organic EL diode "OEL," emitting light according to a current amount is connected to a node between the second and third transistors "P2" and "N3" and a ground voltage "Vcom." For example, the organic EL diode "OEL" may include first and second electrodes and a luminescent layer formed between the first and second electrodes. In addition, the first electrode of the organic EL diode "OEL" may be an anode connected to the second and third transistors "P2" and "N3," and the second electrode of the organic EL diode "OEL" may be a cathode connected to the ground voltage "Vcom" to be grounded.

In addition, a driving method of the organic ELD device of FIG. 6 is described hereinafter. A plurality of gate lines (not shown) are sequentially enabled according to a plurality of gate signals. Since a first transistor "N1" of an N type is adopted, each gate signal has a high level voltage during one horizontal scan time period "1H" to turn on the first transistor "N1." While the high level voltage of each gate signal is applied to the corresponding gate line, the first transistors "N1" connected to the corresponding gate line are turned on and first data signals are applied to the plurality of data lines (not shown). Then, the first transistors "N1" connected to the next gate line are turned on and second data signals are applied to the plurality of data lines (not shown).

For simplicity, the data signals input to the first data line (not shown) are described more in details. While the first gate line (not shown) is enabled during one horizontal scan time period "1H," the first transistors "N1" connected to the first gate line (not shown) are turned on and the first data signal (not shown) for the first data line (not shown) is input to the first transistor "N1" connected to the first data line (not shown). The first data signal (not shown) for the first data line (not shown) is set to have a high level voltage during a first sub-period of the one horizontal scan time period "1H" and a low level voltage during a second sub-period of the one horizontal scan time period "1H." In addition, the first voltage "V1" is set to have a low level voltage during the first sub-period of the one horizontal scan time period "1H" and a high level voltage during the second sub-period of the one horizontal scan time period "1H."

During the first sub-period of the one horizontal scan time period "1H," since the high level voltage of the first data signal (not shown) for the first data line (not shown) is applied to a gate electrode of the second transistor "P2" of a P type through the first transistor "N1," the second transistor "P2" is turned off.

In addition, the low level voltage of the first voltage "V1" is set to be lower than the ground voltage "Vcom." Since the low level voltage of the first voltage "V1" is applied to a source electrode of the third transistor "N3" of an N type, a voltage relatively higher than the low level voltage of the first voltage "V1" is applied to drain and gate electrode of the third transistor "N3." Accordingly, the third transistor "N3" is turned on, and a reverse bias is applied to the organic EL diode "OEL." As a result, the organic EL diode "OEL" is reset by the reverse bias during the first sub-period of the one horizontal scan time period "1H." Therefore, a stress due to a DC current is released.

During the second sub-period of the one horizontal scan time period "1H," since the low level voltage of the first data signal (not shown) for the first data line (not shown) is applied to the second transistor "P2" through the first transistor "N1," the second transistor "P2" is turned on. Further, a difference between the low level voltage of the first data signal (not shown) and the source voltage "VDD" is set to be higher than a threshold voltage of the second transistor "P2," and the source voltage "VDD" is set to be higher than the ground voltage "Vcom." Thus, the source voltage "VDD" is applied to the organic EL diode "OEL," and the organic EL diode "OEL" emits light by a forward bias between the source voltage "VDD" and the ground voltage "Vcom." In addition, since the first voltage "V1" has the high level voltage during the second sub-period of the one horizontal scan time period "1H," the third transistor "N3" is turned off.

Therefore, the organic EL diode "OEL" is reset by the reverse bias during the first sub-period of the one horizontal scan time period "1H," and emits light by the forward bias during the second sub-period of the one horizontal scan time period "1H." As a result, a stress due to a DC current is released and a lifetime of the organic EL diode "OEL" is lengthened. In addition, since the storage capacitor "Cs" is not directly connected to the first voltage "V1," a load connected to the first voltage "V1" having an AC voltage is reduced and a power consumption of the organic ELD device is improved. Moreover, a charging time for the reverse bias is reduced and a reset efficiency is improved.

Figure 7:
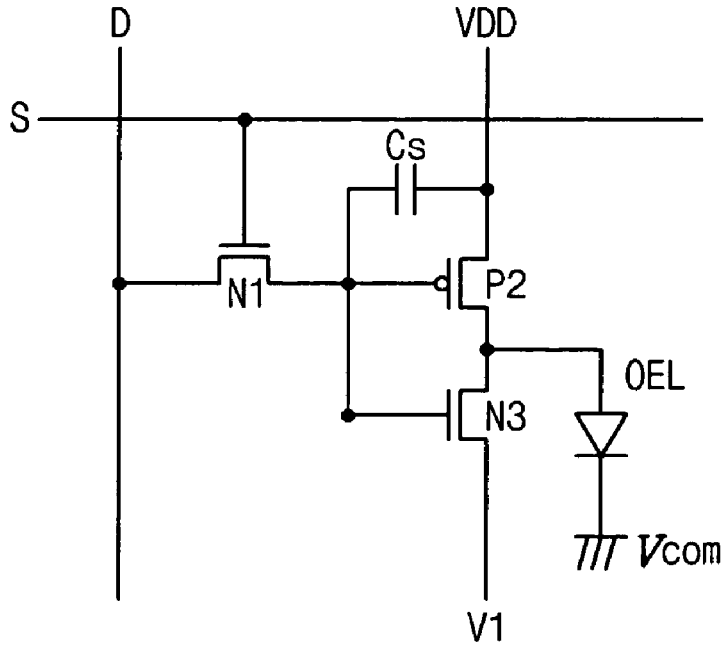
FIG. 7 is a circuit diagram showing an organic electroluminescent display device according to another embodiment of the present invention.

FIG. 7 is a circuit diagram showing an organic electroluminescent display device according to another embodiment of the present invention. In FIG. 7, an organic EL display device includes a gate line "S" crossing a data line "D," thereby defining a pixel region. Even though only a single gate line and a single data line are shown, the organic EL display device may include a plurality of gate lines and a plurality of data lines, thereby defining a plurality of pixel regions. Each pixel region includes first, second and third transistors "N1," "P2" and "N3", a storage capacitor "$C_S$" and an organic electroluminescent (EL) diode "OEL." The first and third transistors, "N1" and "N3," may be negative (N) type thin film transistors, and the second transistor "P2" may be a positive (P) type thin film transistor.

In particular, the first transistor "N1" connected to the gate line "S" and the data line "D" is turned on/off according to a gate signal applied to the gate line "S." The second transistor "P2" is connected to a source voltage "VDD" and controls a current input to the organic EL diode "OEL" according to the data signal from the data line "D" through the first transistor "N1." The third transistor "N3" is connected to a first voltage "V1" and applies a reverse bias to the organic EL diode "OEL" according to the data signal through the first transistor "N1." The first transistor "N1" may function as a switching element, the second transistor "P2" may function functioning as a driving element, and the third transistor "N3" may function as another driving element.

A storage capacitor "Cs" storing charges corresponding to the data signal is connected to a node between the first and second transistors "N1" and "P2" and the source voltage "VDD." The organic EL diode "OEL," emitting light according to a current amount is connected to a node between the second and third transistors "P2" and "N3" and a ground voltage "Vcom." For example, the organic EL diode "OEL" may include first and second electrodes and a luminescent layer formed between the first and second electrodes. In addition, the first electrode of the organic EL diode "OEL" may be an anode connected to the second and third transistors "P2" and "N3," and the second electrode of the organic EL diode "OEL" may be a cathode connected to the ground voltage "Vcom" to be grounded.

In addition, a driving method of the organic ELD device of FIG. 7 is described hereinafter. A plurality of gate lines (not shown) are sequentially enabled according to a plurality of gate signals. Since a first transistor "N1" of an N type is adopted, each gate signal has a high level voltage during one horizontal scan time period "1H" to turn on the first transistor "N1." While the high level voltage of each gate signal is applied to the corresponding gate line, the first transistors "N1" connected to the corresponding gate line are turned on and first data signals are applied to the plurality of data lines (not shown). Then, the first transistors "N1" connected to the next gate line are turned on and second data signals are applied to the plurality of data lines (not shown).

For simplicity, the data signals input to the first data line (not shown) are described more in details. While the first gate line (not shown) is enabled during one horizontal scan time period "1H," the first transistors "N1" connected to the first gate line (not shown) are turned on and the first data signal (not shown) for the first data line (not shown) is input to the first transistor "N1" connected to the first data line (not shown). The first data signal (not shown) for the first data line (not shown) is set to have a high level voltage during a first sub-period of the one horizontal scan time period "1H" and a low level voltage during a second sub-period of the one horizontal scan time period "1H." In addition, the first voltage "V1" is set to have a low level voltage during the first sub-period of the one horizontal scan time period "1H" and a high level voltage during the second sub-period of the one horizontal scan time period "1H."

During the first sub-period of the one horizontal scan time period "1H," since the high level voltage of the first data signal (not shown) for the first data line (not shown) is applied to a gate electrode of the second transistor "P2" of a P type through the first transistor "N1," the second transistor "P2" is turned off. Further, the high level voltage of the first data signal (not shown) also is applied to a gate electrode of the third transistor "N3" of a N type through the first transistor "N1," the third transistor "N3" is turned on.

In addition, the low level voltage of the first voltage "V1" is set to be lower than the ground voltage "Vcom." Thus, the low level voltage of the first voltage "V1" lower than the ground voltage "Vcom" is applied to the organic EL diode "OEL" through the third transistor "N3." As a result, a reverse bias is applied to the organic EL diode "OEL" and the organic EL diode "OEL" is reset by the reverse bias during the first sub-period of the one horizontal scan time period "1H." Therefore, a stress due to a DC current is released.

During the second sub-period of the one horizontal scan time period "1H," since the low level voltage of the first data signal (not shown) for the first data line (not shown) is applied to the gate electrodes of the second and third transistors "P2" and "N3" through the first transistor "N1," the second transistor "P2" is turned on and the third transistor "N3" is turned off. Further, a difference between the low level voltage of the first data signal (not shown) and the source voltage "VDD" is set to be higher than a threshold voltage of the second transistor "P2," and the source voltage "VDD" is set to be higher than the ground voltage "Vcom." Thus, the source voltage "VDD" is applied to the organic EL diode "OEL," and the organic EL diode "OEL" emits light by a forward bias between the source voltage "VDD" and the ground voltage "Vcom."

Therefore, the organic EL diode "OEL" is reset by the reverse bias during the first sub-period of the one horizontal scan time period "1H," and emits light by the forward bias during the second sub-period of the one horizontal scan time period "1H." As a result, a stress due to a DC current is released and a lifetime of the organic EL diode "OEL" is lengthened. In addition, since the storage capacitor "Cs" is not directly connected to the first voltage "V1," a load connected to the first voltage "V1" having an AC voltage is reduced and a power consumption of the organic ELD device is improved. Moreover, a charging time for the reverse bias is reduced and a reset efficiency is improved.

Accordingly, an organic electroluminescent display device of an embodiment of the present invention includes elements for resetting an organic electroluminescent diode without increase of power consumption. As a result, a lifetime of an organic electroluminescent display device is lengthened and a reset efficiency is improved.

It will be apparent to those skilled in the art that various modifications and variations can be made in the organic electroluminescent display device and driving method thereof of the present invention without departing from the spirit or scope of the invention. Thus, it is intended that the present invention covers the modifications and variations of this invention provided they come within the scope of the appended claims and their equivalents.

What is claimed is:

1. An organic electroluminescent display device, comprising:

a gate line receiving a gate signal;

a data line crossing the gate line, the data line receiving a data signal;

a first transistor switching the data signal according to the gate signal, the first transistor being turned on during a single horizontal scan time period having first and second sub-periods;

a second transistor switching a source voltage according to the data signal and connected to the first transistor;

a storage capacitor connected to a first node between the first and second transistors and connected to the source voltage;

a third transistor switching a first voltage signal and connected to the second transistor, the first voltage signal having different voltage levels during the first and second sub-periods of the single horizontal scan time period; and an organic electroluminescent diode connected to a second node between the second and third transistors and connected to a ground voltage.

2. The device according to claim 1, wherein during the first sub-period of the single horizontal scan time period, the first voltage signal has a first voltage level being lower than the ground voltage, and during the second sub-period of the single horizontal scan time period, the first voltage signal has a second voltage level being higher than the first voltage level.

3. The device according to claim 1, wherein during the first sub-period of the single horizontal scan time period, the second transistor is turned off and the third transistor is turned on, and during the second sub-period of the single horizontal scan time period, the second transistor is turned on and the third transistor is turned off.

4. The device according to claim 1, the first, second and third transistors are p-type thin film transistors.

5. The device according to claim 4, wherein a gate electrode and a source electrode of the third transistor are connected to the first voltage signal, and a drain electrode of the third transistor is connected to the organic electroluminescent diode.

6. The device according to claim 1, wherein the second transistor is a p-type thin film transistor, and the first and third transistors are n-type thin film transistors.

7. The device according to claim 6, wherein a gate electrode and a drain electrode of the third transistor are connected to the organic electroluminescent diode, and a source electrode of the third transistor is connected to the first voltage signal.

8. The device according to claim 6, wherein a gate electrode of the third transistor is connected to the first node, a source electrode of the third transistor is connected to the first voltage signal, and a drain electrode of the third transistor is connected to the organic electroluminescent diode.

9. The device according to claim 1, wherein the data signal has a high level voltage during the first sub-period of the single horizontal scan time period and a low level voltage lower than the high level voltage during the second sub-period of the single horizontal scan time period.

10. The device according to claim 1, during the first sub-period of the single horizontal scan time period, a reverse bias current is applied to the organic electroluminescent diode, and during the second sub-period of the single horizontal scan time period, a forward bias current is applied to the organic electroluminescent diode.

11. A method of driving an organic electroluminescent display device, comprising:

turning on a first transistor during a single horizontal scan time period having first and second sub-periods;

inputting a data signal to a second transistor through the first transistor during the single horizontal scan time period;

storing charges corresponding to the data signal in a storage capacitor, the storage capacitor being between two electrodes of the second transistor;

applying a first voltage signal to an organic electroluminescent diode through a third transistor during the first sub-period of the single horizontal scan time period, the first voltage signal having different voltage levels during the first and second sub-periods of the single horizontal scan time period; and applying a source voltage to the organic electroluminescent diode through the second transistor during the second sub-period of the single horizontal scan time period.

12. The method according to claim 11, further comprising:

setting the first voltage signal to have a first voltage level being lower than a ground voltage during the first sub-period of the single horizontal scan time period; and setting the first voltage signal to have a second voltage level being higher than the first voltage level during the second sub-period of the single horizontal scan time period.

13. The method according to claim 11, further comprising:

during the first sub-period of the single horizontal scan time period, turning off the second transistor and turning on the third transistor;

during the second sub-period of the single horizontal scan time period, turning on the second transistor and turning off the third transistor.

14. The method according to claim 11, wherein the first, second and third transistors are p-type thin film transistors.

15. The method according to claim 14, further comprising:

applying the first voltage signal to a gate electrode and a source electrode of the third transistor; and connecting a drain electrode of the third transistor to the organic electroluminescent diode.

16. The method according to claim 11, wherein the second transistor is a p-type thin film transistor, and the first and third transistors are n-type thin film transistors.

17. The method according to claim 16, further comprising:

connecting a gate electrode and a drain electrode of the third transistor to the organic electroluminescent diode; and applying the first voltage signal to a source electrode of the third transistor.

18. The method according to claim 16, further comprising:

connecting a gate electrode of the third transistor to the same node as a gate electrode of the second transistor;

applying the first voltage signal to a source electrode of the third transistor; and connecting a drain electrode of the third transistor to the organic electroluminescent diode.

19. The method according to claim 11, further comprising:

setting the data signal to have a high level voltage during the first sub-period of the single horizontal scan time period and a low level voltage lower than the high level voltage during the second sub-period of the single horizontal scan time period.

20. The method according to claim 11, wherein during the first sub-period of the single horizontal scan time period, a reverse bias current flows through the organic electroluminescent diode when the first voltage signal is applied thereto, and during the second sub-period of the single horizontal scan time period, a forward bias current flows through the organic electroluminescent diode when the source voltage is applied thereto.

* * * * *